US009827789B2

(12) United States Patent
Takatsu et al.

(10) Patent No.: US 9,827,789 B2
(45) Date of Patent: Nov. 28, 2017

(54) INKJET PRINTING METHOD

(71) Applicant: MIMAKI ENGINEERING CO., LTD., Nagano (JP)

(72) Inventors: Akira Takatsu, Nagano (JP); Tomotaka Furuhata, Nagano (JP)

(73) Assignee: MIMAKI ENGINEERINGS CO., LTD., Nagano (JP)

( * ) Notice: Subject to any disclaimer, the term of this patent is extended or adjusted under 35 U.S.C. 154(b) by 0 days.

(21) Appl. No.: 15/027,428

(22) PCT Filed: Sep. 29, 2014

(86) PCT No.: PCT/JP2014/075780

§ 371 (c)(1),
(2) Date: Apr. 5, 2016

(87) PCT Pub. No.: WO2015/053104

PCT Pub. Date: Apr. 16, 2015

(65) Prior Publication Data

US 2016/0250864 A1 Sep. 1, 2016

(30) Foreign Application Priority Data

Oct. 7, 2013 (JP) ..... 2013-210575

(51) Int. Cl.

| | |
|---|---|
| ***B41J 2/01*** | (2006.01) |
| ***B41J 11/00*** | (2006.01) |
| ***B41M 3/00*** | (2006.01) |
| *B41M 7/00* | (2006.01) |

(52) U.S. Cl.

CPC ..... *B41J 11/002* (2013.01); *B41J 2/01* (2013.01); *B41M 3/008* (2013.01); *B41M 7/0081* (2013.01)

(58) Field of Classification Search

CPC .. B41M 7/0027; B41M 7/009; B41M 7/0081; B41M 3/008; B41J 11/002; B41J 11/0015; B41J 2/01

USPC ..... 347/5, 20, 102; 428/32.24, 32.34, 32.77

See application file for complete search history.

(56) References Cited

U.S. PATENT DOCUMENTS

2013/0293609 A1* 11/2013 Ohkawa ..... B41J 2/01 347/9

FOREIGN PATENT DOCUMENTS

| | | |
|---|---|---|
| CN | 103269861 | 8/2013 |
| JP | 2004-358769 | 12/2004 |
| JP | 2010-6027 | 1/2010 |
| JP | 2010-195002 | 9/2010 |

(Continued)

OTHER PUBLICATIONS

International Search Report (Form PCT/ISA/210), dated Jan. 6, 2015, pp. 1-4, with English translation thereof.

(Continued)

*Primary Examiner* — Jannelle M Lebron
(74) *Attorney, Agent, or Firm* — JCIPRNET

(57) ABSTRACT

An inkjet printing method is provided. A smear-free printed matter superior in glossiness can be obtained. The inkjet printing method includes: a second ink layer forming step of discharging a second ink on a first ink layer formed on a recording medium and drying the discharged second ink, and a third ink layer forming step of discharging a third ink on the second ink layer and drying the discharged third ink. A drying time during the second ink layer forming step is shorter than a drying time during the third ink layer forming step.

10 Claims, 3 Drawing Sheets

(56) References Cited

FOREIGN PATENT DOCUMENTS

| | | |
|---|---|---|
| JP | 2012-106473 | 6/2012 |
| WO | 2012121218 | 9/2012 |

OTHER PUBLICATIONS

"Search Report of Europe Counterpart Application", dated Dec. 8, 2016, p. 1-p. 9, in which the listed reference was cited.
"Office Action of China Counterpart Application" with English translation thereof, dated Aug. 24, 2016, p. 1-p. 11, in which the listed reference was cited.
"Office Action of Japan Counterpart Application," with English translation thereof, dated Jun. 6, 2017, p. 1-p. 8.

* cited by examiner

INKJET PRINTING METHOD

CROSS-REFERENCE TO RELATED APPLICATION

This application is a 371 of international application of PCT application serial no. PCT/JP2014/075780, filed on Sep. 29, 2014, which claims the priority benefit of Japan application no. JP 2013-210575, filed on Oct. 7, 2013. The entirety of each of the above-mentioned patent applications is hereby incorporated by reference herein and made a part of this specification.

TECHNICAL FIELD

This invention relates to an inkjet printing method.

BACKGROUND ART

Conventionally, inkjet printing methods using inks of ultraviolet curing type form an ink layer on a recording medium by discharging an ink of ultraviolet curing type thereon, and then irradiate the formed ink layer with ultraviolet light to cure the ink layer. The patent literature 1 describes an example of the known inkjet printing methods using inks of ultraviolet curing type.

CITATIONS LIST

Patent Literature

Patent Literature 1: JP 2004-358769 A (disclosed on Dec. 24, 2004)

SUMMARY

Technical Problems

Some of the inks of ultraviolet curing type may be colorant-free transparent inks. Such inks are known as clear inks. The clear inks may be used as overcoats on color prints or used as coating materials or the like for recording media. When an ink of ultraviolet curing type is discharged on a recording medium by the inkjet printing method described in Patent Literature 1, irregularities may be observed on the surface of an ink layer immediately after the ink landed on the recording medium. In cases where a clear ink is used as an overcoat, reflectivity may vary at different spots of the irregularities, producing a printed matter with uneven glossiness.

A conventional solution may include flattening the irregularities on the ink layer surface over a certain period of time and irradiating the flattened surface with ultraviolet light. Using a clear ink as an overcoat requires excellent glossiness to be achieved. Therefore, it is necessary to flatten the surface of a clear ink layer over an adequately long time.

During the flattening of the clear ink layer, however, the clear ink may bleed into an ink of an underlying color layer, blurring an image to be obtained.

To address these conventional issues still unsolved, this invention provides an inkjet printing method that may obtain a smear-free printed matter with superior glossiness.

Solutions to Problems

An inkjet printing method disclosed herein includes a second ink layer forming step of discharging a second ink on a first ink layer formed on a recording medium and drying the discharged second ink to form a second ink layer, and a third ink layer forming step of discharging a third ink on the formed second ink layer and drying the discharged third ink to form a third ink layer. In this method, a drying time during the second ink layer forming step is shorter than a drying time during the third ink layer forming step.

With this configuration, the second ink is dried over a short period of time during the second ink layer forming step of forming the second ink layer in contact with the first ink layer. This may speedily prevent the second ink from bleeding into the ink of the first ink layer. Since the third ink layer is formed on the second ink layer and dried over a long time, the surface of the third ink layer may be sufficiently flattened. As a result, a smear-free and very glossy printed matter may be obtainable.

In the inkjet printing method disclosed herein, the first ink used to form the first ink layer may preferably be a solvent-soluble ink Accordingly, when a solvent-soluble ink easy to smear is used as the first ink to form the first ink layer, a smear-free and very glossy printed matter may still be obtainable by quickly drying the second ink to form the second ink layer in contact with the first ink layer.

In the inkjet printing method disclosed herein, the second ink and the third ink are preferably the same ink.

Accordingly, the same ink is used as the second and third inks, and the drying time of the second ink layer is shortened as compared to the drying time of the third ink layer. By way of these simple means alone, the second ink layer may prevent smearing of the first ink layer, and the third ink layer may impart excellent glossiness to a printed matter. As a result, a smear-free and very glossy printed matter may be readily obtainable.

In the inkjet printing method disclosed herein, the third ink may preferably be a clear ink.

This may afford adequate flatness and excellent glossiness to the surface of the third ink layer. Using the clear ink to form the third ink layer may provide for an overcoat with superior glossiness.

In the inkjet printing method disclosed herein, the second ink may preferably be an ink of ultraviolet curing type.

Accordingly, forming the second ink layer using a quick-drying ink of ultraviolet curing type may render an obtained printed matter even more smear-free.

Advantageous Effects of Invention

According to the inkjet printing method disclosed herein, the drying time during the second ink layer forming step of forming the second ink layer on the first ink layer is shorter than the drying time during the third ink layer forming step of forming the third ink layer on the second ink layer. Advantageously, the ink of the first ink layer may be prevented from dissolving and starting to bleed, and an obtained printed matter coated with the third ink layer may attain superior glossiness.

DESCRIPTION OF EMBODIMENTS

An embodiment of the invention is hereinafter described in detail referring to FIGS. 1A-1D. FIGS. 1A-1D are schematic drawings illustrating an inkjet printing method according to an embodiment. The inkjet printing method according to this embodiment includes a second ink layer forming step and a third ink layer forming step. The second ink layer forming step discharges a second ink on a first ink layer 1 formed on a recording medium 10 and dries the discharged second ink. The third ink layer forming step discharges a third ink on a second ink layer 2 formed during the earlier step and dries the discharged third ink. According to this inkjet printing method, a drying time during the second ink layer forming step is shorter than a drying time during the third ink layer forming step. The second ink is dried over a shorter period of time than the drying time during the third ink layer forming step, while the third ink is dried over a longer period of time than the drying time during the second ink layer forming step. That is to say, the second ink layer is dried more quickly than the third ink layer.

[First Ink Layer Forming Step]

Figure 1A:
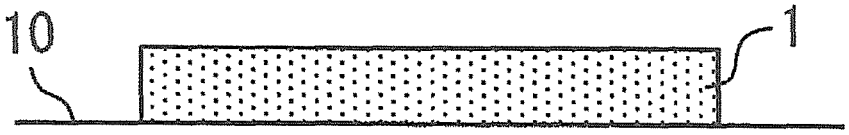
FIGS. 1A-1D are schematic drawings illustrating an inkjet printing method according to an embodiment.

As illustrated in FIG. 1A, the inkjet printing method disclosed herein may further include a first ink layer foaming step of forming the first ink layer 1 on the recording medium 10. The first ink layer forming step discharges a first ink that forms the first ink layer 1 on the recording medium 10 and dries the discharged first ink. Any suitable ink jet print device known in the art may be employed to discharge the first ink on the recording medium 10. The recording medium 10 may be any one suitably selected from known recording media.

The first ink used to form the first ink layer 1 may be selected from known inks of different types including inks of ultraviolet curing type, solvent inks, latex inks, and colorant-containing color inks. The first ink may preferably be a quick-drying ink of ultraviolet curing type.

When an ink of ultraviolet curing type is used as the first ink in the first ink layer forming step, the first ink may be discharged on the recording medium 10 and then irradiated with ultraviolet light emitted from, for example, LED to cure the first ink layer 1. This may more speedily complete the formation of the first ink layer 1.

The first ink may be a solvent-soluble ink Examples of the solvent-soluble inks may include LUS-150, LF-140, LF-200, and LUS-200 supplied by MIMAKI ENGINEERING CO., LTD. Even when a solvent-soluble ink easy to smear is used as the first ink to form the first ink layer 1, a smear-free and very glossy printed matter may still be obtainable by, as described later, quickly drying the second ink to form the second ink layer 2 in contact with the first ink layer 1.

[Second Ink Layer Forming Step]

Figure 1B:
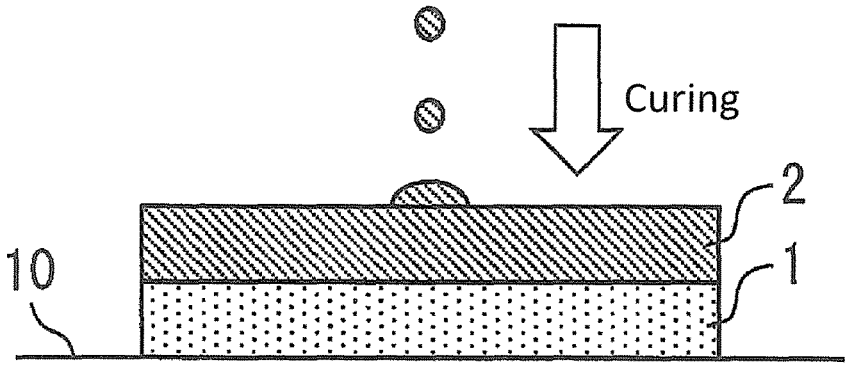

As illustrated in FIG. 1B, the second ink layer forming step discharges the second ink on the first ink layer 1 formed on the recording medium 10 and dries the discharged second ink to form the second ink layer 2. A drying time during the second ink layer forming step is shorter than a drying time during the third ink layer forming step. Any suitable ink jet print device known in the art may be employed to discharge the second ink on the first ink layer 1 and dry the second ink layer 2.

During the second ink layer forming step of forming the second ink layer in contact with the first ink layer, the drying time of the second ink for the second ink layer to be formed is shortened. This may prevent the second ink from bleeding into the ink of the first ink layer. According to the method disclosed herein, the third ink layer is formed on the second ink layer 2. In cases where the second ink is dried too soon to be sufficiently spread out, the surface of the second ink layer 2 may have irregularities. Yet, by flatting the surface of the outermost third ink layer, an obtained printed matter may attain superior glossiness. As a result, a smear-free and very glossy printed matter may be obtainable.

The second ink layer forming step may preferably start to dry the second ink simultaneously with the arrival of the second ink on the first ink layer 1. The second ink layer forming step may preferably dry the second ink on the first ink layer 1 while the second ink is being discharged. This may further reliably avoid smearing of the first ink layer 1.

The second ink used to form the second ink layer 2 may be selected from known inks of different types including inks of ultraviolet curing type and latex inks, and may be a colorant-containing color ink or colorant-free clear ink. The second ink may preferably be a quick-drying ink of ultraviolet curing type. The second ink layer 2 may be formed of a solvent-resistant liquid other than inks. The second ink layer 2 may be a smear-free layer undissolvable in the third ink used to form the third ink layer 3.

When an ink of ultraviolet curing type is used as the second ink in the second ink layer forming step, the second ink may be irradiated with ultraviolet light emitted from, for example, LED after or while being discharged on the first ink layer 1 in order to cure the second ink layer 2. The formation of the second ink layer 2 may be more speedily completed. By using an ink of ultraviolet curing type as the second ink, the second ink layer 2 may be more quickly curable. This may more reliably prevent smearing of the first ink layer 1.

Taking too much time to dry the second ink layer 2 may lead to smearing of the first ink layer 1. Therefore, the drying time of the second ink layer 2 during the second ink layer forming step may preferably be short enough to prevent smearing of the first ink layer 1. In cases where the second ink is an ink in which the first ink is easily dissolvable, the drying time of the second ink may preferably be shortened as compared to cases where an ink in which the first ink is difficult to dissolve is used.

The drying time of the second ink layer 2 may be shortened as compared to the drying time of the third ink layer by, for example, controlling manners of drying the discharged inks. Specifically, the second ink may be dried as soon as it is discharged to form the second ink layer 2, while the third ink discharged may be dried after a certain period of time has passed to form the third ink layer 3. Alternatively, the second ink layer 2 may be formed in a smaller thickness than the third ink layer 3, or the second ink, in the event of a solvent ink, may be a more quick-drying ink than the third ink in order to reduce the drying time of the second ink layer 2 as compared to the drying time of the third ink layer 3.

[Third Ink Layer Forming Step]

Figure 1C:
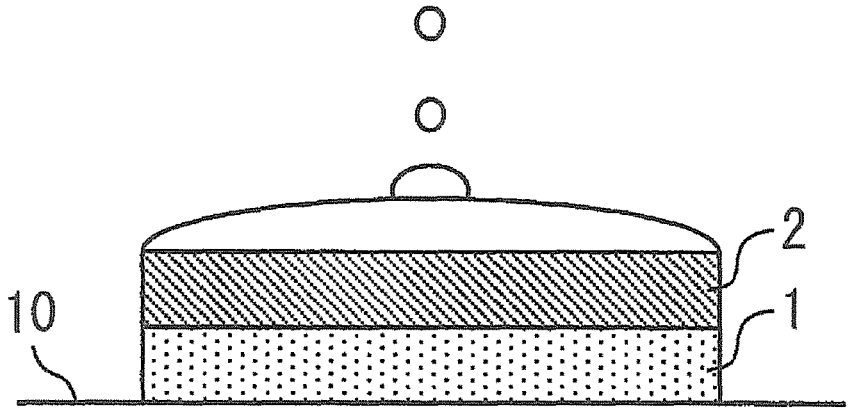
Figure 1D:
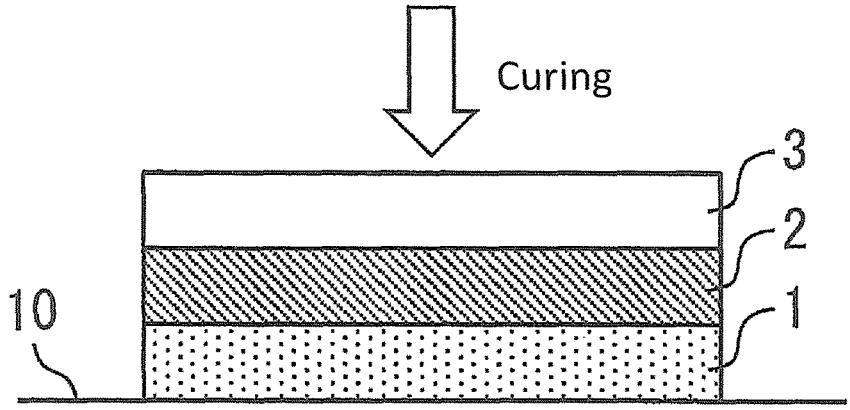

As illustrated in FIGS. 1C and 1D, the third ink layer forming step discharges the third ink on the second ink layer 2 and then dries the discharged third ink to form the third ink layer 3. The drying time during the third ink layer forming step is longer than the drying time during the second ink layer forming step. Any suitable ink jet print device known in the art may be employed to discharge the third ink on the second ink layer 2 and dry the third ink layer 3.

The third ink layer forming step may preferably start to dry the third ink sufficiently long after it has landed on the second ink layer 2 for adequate flatness. By thus ensuring the surface flatness of the third ink layer, a printed matter with superior glossiness may be obtainable.

The third ink used to form the third ink layer 3 may be selected from known inks of different types including inks of ultraviolet curing type, solvent inks, and latex inks, and may be a colorant-containing color ink or colorant-free clear ink. This may afford adequate flatness and excellent glossiness to the surface of the third ink layer. Using the clear ink to form the third ink layer may provide for an overcoat with superior glossiness.

When an ink of ultraviolet curing type is used as the third ink, the third ink is discharged in the the third ink layer forming step on the second ink layer 2 and then irradiated with ultraviolet light emitted from, for example, LED to cure the third ink layer 3.

If the third ink that has landed on the second ink layer 2 is dried too soon to be sufficiently spread out, the surface of the third ink layer 3 may have irregularities, resulting in uneven glossiness. The drying time during the third ink layer forming step required to dry the third ink and thereby form the third ink layer may preferably be longer than the drying time during the second ink layer forming step and long enough to flatten the surface of the third ink layer 3.

According to this invention, the second ink layer 2 is interposed between the first ink layer 1 and the third ink layer 3 to avoid direct contact between the layers 1 and 3. Therefore, the third ink may be sufficiently spread out over a long time to flatten the surface of the third ink layer 3 without the risk of smearing the first ink layer 1. Therefore, the third ink may be fully spread out without any concern for the ink smearing problem. As a result, a printed matter with superior glossiness may be obtainable.

The invention is not necessarily limited to the embodiments described above and may be carried out in many other forms. The technical scope of the invention encompasses any modifications within the scope of the invention defined by the appended claims and embodiments obtained by variously combining the technical means disclosed herein.

[Additional Remarks]

An inkjet printing method disclosed herein includes a second ink layer forming step of discharging a second ink on a first ink layer 1 formed on a recording medium 10 and drying the discharged second ink to form a second ink layer 2, and a third ink layer forming step of discharging a third ink on the formed second ink layer 2 and drying the discharged third ink to form a third ink layer 3. In this method, a drying time during the second ink layer forming step is shorter than a drying time during the third ink layer forming step.

With this configuration, the second ink is dried over a short period of time during the second ink layer forming step of forming the second ink layer 2 in contact with the first ink layer 1. This may prevent the second ink from bleeding into the ink of the first ink layer 1. The third ink layer 3 is formed on the second ink layer 2 and dried over a long time. Therefore, the surface of the third ink layer 3 may be sufficiently flattened. As a result, a smear-free and very glossy printed matter may be obtainable.

In the inkjet printing method disclosed herein, the first ink used to form the first ink layer 1 may preferably be a solvent-soluble ink.

Accordingly, a solvent-soluble ink easy to smear is used as the first ink to form the first ink layer 1, a smear-free and very glossy printed matter may still be obtainable by quickly drying the second ink to form the second ink layer 2 in contact with the first ink layer 1.

In the inkjet printing method disclosed herein, the second ink and the third ink are the same ink Accordingly, the same ink is used as the second and third inks, and the drying time of the second ink layer 2 is shortened as compared to the drying time of the third ink layer 3. By way of these simple means alone, the second ink layer 2 may prevent smearing of the first ink layer 1, and the third ink layer 3 may impart excellent glossiness to a printed matter. As a result, a smear-free and very glossy printed matter may be obtainable.

In the inkjet printing method disclosed herein, the third ink may preferably be a clear ink.

This may afford adequate flatness and excellent glossiness to the surface of the third ink layer 3. Using the clear ink to form the third ink layer 3 may provide for an overcoat with superior glossiness.

In the inkjet printing method disclosed herein, the second ink may preferably be an ink of ultraviolet curing type.

Accordingly, forming the second ink layer 2 using a quick-drying ink of ultraviolet curing type may render an obtained printed matter even more smear-free.

EXAMPLE

An example of this invention is hereinafter described referring to FIGS. 2 and 3.

In a test performed to evaluate printed matters were used an ink jet printer, UJF-3042 (MIMAKI ENGINEERING CO., LTD., head temperature: 45° C.), and recording media, U292W (Teijin DuPont Films Japan Limited).

Four color inks, namely, cyan, magenta, yellow, and black of LUS-150 (MIMAKI ENGINEERING CO., LTD.) were discharged on two recording media to form color ink layers thereon. The printing conditions of first ink layers were 720×600 dpi/8 passes and accumulated light amount of 120 mJ/cm$^2$.

An ink, LH-100CL (MIMAKI ENGINEERING CO., LTD.) was discharged on the obtained color ink layers to form a clear ink layer on each of them. The clear ink layer was formed by matt printing on the color ink layer on one of the recording media (printing conditions: 720×600 dpi/4 passes), while the clear ink layer was formed by gloss printing on the color ink layer on the other recording medium (printing conditions: 720×600 dpi/4 passes). Provided that time required to discharge and dry the inks on the recording media is defined as printing time, printing times with recording media in the size of 42 cm long by 30 cm wide were approximately one minute in matt printing, and approximately two minutes in gloss printing. The drying time required in matt printing was shorter than the drying time required in gloss printing. On one of the recording media with the matt-printed clear ink layer, the ink, LH-100CL, was further applied to the clear ink layer by gloss printing.

Figure 2:
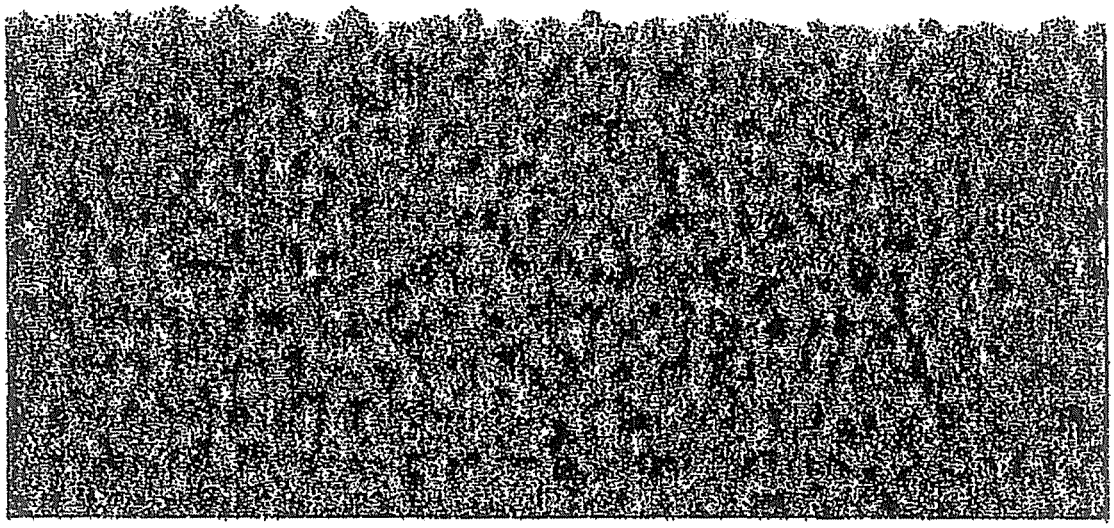
FIG. 2 is a drawing presenting a microphotograph of a print result according to an example.
Figure 3:
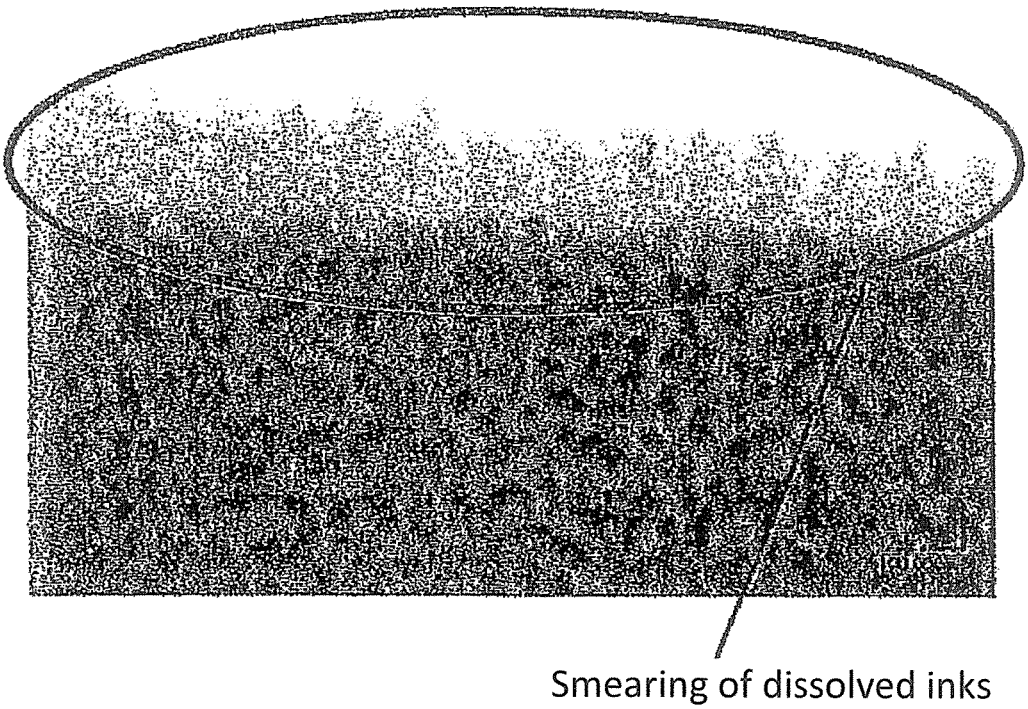
FIG. 3 is a drawing presenting a microphotograph of a print result according to a comparative example.

FIGS. 2 and 3 show the test results. FIG. 2 is a drawing presenting a microphotograph of the print result according to this example. FIG. 3 is a drawing presenting a microphotograph of the print result according to the comparative example. As illustrated in FIG. 2, the matt-printed clear ink layer was formed on the color ink layer and further subjected to gloss printing on one of the recording media. This recording medium had a smear-free color ink layer, and a very glossy printed matter was obtained. As illustrated in FIG. 3, the clear ink layer was directly formed on the color ink layer by gloss printing on the other record medium. In this recording medium, smearing of the inks was observed in the interface between the color ink layer and the clear ink layer.

As described thus far, providing the matt-printed layer using the clear ink between the color ink layer and the gloss-printed clear ink layer may effectively prevent the color ink from dissolving and starting to bleed. Further advantageously, an obtained printed matter having a gloss-finished outermost surface may exhibit a very glossy appearance.9

INDUSTRIAL APPLICABILITY

This invention is usefully applicable to ink jet printing.

The invention claimed is:

1. An inkjet printing method, comprising:

a second ink layer forming step of discharging a second ink on a first ink layer, which is formed and dried on a recording medium, and drying the second ink discharged to form a second ink layer; and a third ink layer forming step of discharging a third ink on the second ink layer and drying the third ink discharged to form a third ink layer, wherein a drying time during the second ink layer forming step is shorter than a drying time during the third ink layer forming step, wherein the first ink layer formed by discharging and drying a first ink is soluble in the second ink, and the first ink bleeds due to the third ink;

a drying of the second ink is performed earlier than the bleeding of the dried first ink layer; and the third ink is dried with a sufficient time to spread out to flatten a surface of the third ink layer on the second ink layer.

2. The inkjet printing method according to claim 1, wherein the second ink is an ultraviolet curing type ink.

3. The inkjet printing method according to claim 1, wherein the second ink layer is a smear-free layer undissolvable in the third ink.

4. The inkjet printing method according to claim 1, wherein the second ink is a clear ink.

5. The inkjet printing method according to claim 1, wherein the first ink is an ultraviolet curing type ink.

6. The inkjet printing method according to claim 1, wherein the second ink and the third ink are an identical ink.

7. The inkjet printing method according to claim 6, wherein the third ink is a clear ink.

8. The inkjet printing method according to claim 6, wherein the second ink is an ultraviolet curing type ink.

9. The inkjet printing method according to claim 1, wherein the third ink is a clear ink.

10. The inkjet printing method according to claim 9, wherein the second ink is an ultraviolet curing type ink.

* * * * *